US005456329A

United States Patent [19]

Dennis et al.

[11] Patent Number: 5,456,329

[45] Date of Patent: Oct. 10, 1995

[54] BIFURCATED DRILL BIT CONSTRUCTION

[75] Inventors: Thomas M. Dennis; Mark Hunt, both of Houston, Tex.

[73] Assignee: Dennis Tool Company, Houston, Tex.

[21] Appl. No.: 197,934

[22] Filed: Feb. 16, 1994

[51] Int. Cl.[6] ..... E21B 10/36

[52] U.S. Cl. ..... 175/420.2; 299/100; 175/431

[58] Field of Search ..... 175/416, 414, 175/420.2, 431, 434; 299/94

[56] References Cited

U.S. PATENT DOCUMENTS

| | | | |
|---|---|---|---|
| 4,593,777 | 6/1986 | Barr | 175/431 X |
| 4,830,123 | 5/1989 | Daly et al. | 175/431 |
| 5,172,778 | 12/1982 | Tibbitts et al. | 175/431 X |
| 5,180,022 | 1/1993 | Brady | 175/431 X |
| 5,303,787 | 4/1994 | Brady | 175/431 X |
| 5,373,908 | 12/1994 | Pastusek | 175/431 |
| 5,377,773 | 1/1995 | Tibbitts | 175/431 X |

*Primary Examiner*—Roger J. Schoeppel
*Attorney, Agent, or Firm*—Gunn & Associates

[57] ABSTRACT

An improved bifurcated drill bit is set forth. It has a shank for connection with a chuck, a cylindrical head having an outer face, and duplicate cutter faces. Each cutter is formed of PDC inserts which are cylindrical (or segments thereof). The PDC inserts are formed from a circular disk or ring which has an alignment hole in the center. When mounted, the insert presents a PDC face which bears against the drill hole. The drill hole is formed by cutting action of the inserts. Impact and shock loading occurs at the PDC surface.

14 Claims, 1 Drawing Sheet

FIG. 1
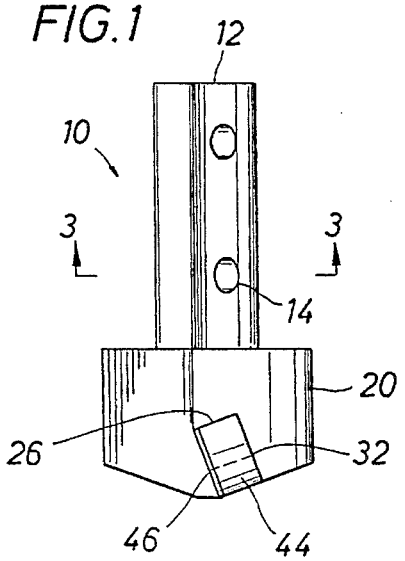
FIG. 2
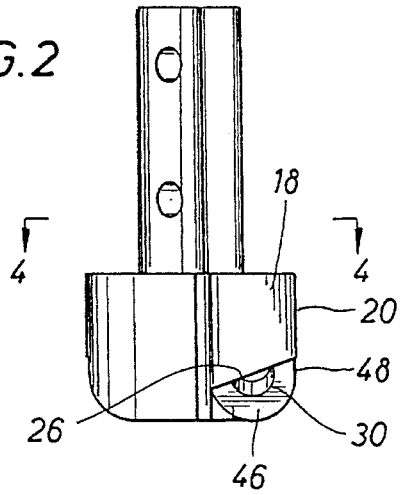
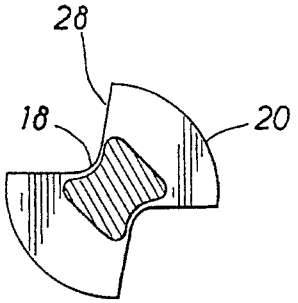
FIG. 4
FIG. 3
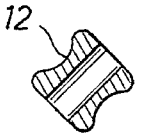
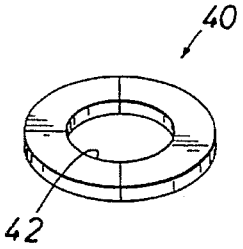
FIG. 6
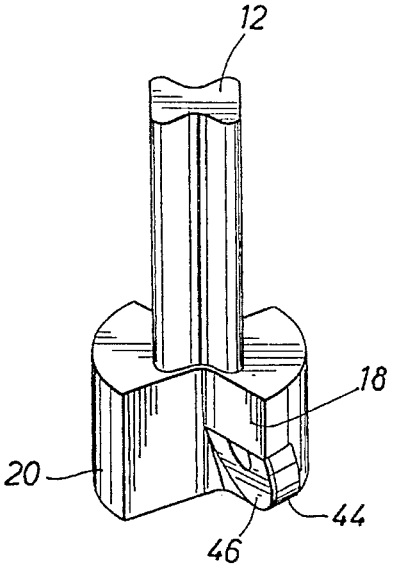
FIG. 5

BIFURCATED DRILL BIT CONSTRUCTION

BACKGROUND OF THE DISCLOSURE

The present disclosure is directed to a drill bit construction and more particularly to a drill bit construction which includes or incorporates a bifurcated body which supports two cutting faces. It is constructed at the end of a stem which is suitably connected with a chuck and drill motor which especially finds use in drilling long holes in shaft mines for anchoring mine support timbers. When a mine is extended into an overburden, shoring is required to support the overburden and to prevent collapse of the mine roof on people in the mine. This is accomplished by shoring up corridors in the mine with vertical columns connected with roof beams. The shoring is anchored to the overburden. This is typically done by drilling numerous small holes up to about 5 feet in depth into the overburden. The holes need only be about 1 or 3 inches in diameter to provide adequate connection for an anchor rod which is positioned in the drilled hole. The anchor rod connects to the shoring to assure proper supportive interconnection.

The interconnection which is necessary is important to the safety of the mine. The anchor rods are normally positioned in the holes of perhaps 1 to 3 inches in diameter by bonding the rods in the holes. This requires drilling of hundreds or typically thousands of holes for a given situation. To drill all of the holes, it is necessary to use a drill bit which is capable of drill through rock. The bifurcated bit structure of this disclosure is well able to provide hundreds of drilled holes thereby extending the life of the device substantially in comparison with drill bits now in vogue. In one aspect, the drill bit of the present disclosure is a device which is provided with duplicate spaced cutters. In this particular embodiment, the cutter is supported on a tool steel body. The body is formed of a hard steel, one choice being 4340 steel. The body supports two cutting inserts. The inserts are attached by brazing. In addition to that, the cutters are faced with a planar coating of polycrystalline diamond compact PDC hereinafter) which is bonded by brazing or the like. This reinforces the insert face and enables the bifurcated bit to last substantially longer.

The drill bit body is constructed with a sloping face having a semi-cylindrical mounting surface in the central portion of the face. The curving portion serves as a lock to receive an insert which is brazed to it. The insert, formed of PDC, is attached on the semi-cylindrical surface in conjunction with the shoulder. This provides locking multiple surfaces at angled positions to assure that the PDC insert is held throughout the life of the device. This safely anchors the PDC insert. In addition to that, it enables the PDC to be presented at drilled hole surfaces which enable enhanced contact with the hole during drilling. The leading face of the PDC insert is overlaid with a thin layer of diamond which is brazed or otherwise bonded to it. That enhances the protection of the bifurcated cutting tool of the present disclosure.

In one aspect of this equipment, the insert is formed of PDC which is cut from a circular blank. Furthermore, this blank is in the form of a PDC circular blank or segments thereof having, requisite thickness. This segment of material defining the faced cutter element thus forms two PDC inserts from a single PDC disk of cutting material. When cut, the two parts are readily made for the two cutter faces.

BRIEF SUMMARY OF THE DISCLOSED APPARATUS

This disclosure sets forth in great detail an improved drill bit which finds special application in drilling narrow holes as for example, holes having a diameter of about 1 to 3 inches and a depth of 3 to 5 feet. It is especially intended for use in shaft mines to anchor the overburden with the shoring in the mines. The stem enabling connection with a chuck terminates at a head portion which is formed with equal and opposite faces, the faces being spaced across the structure and enabling the PDC inserts to be anchored. Before the PDC inserts are attached, they are shaped to fit on a sloping shoulder which is interrupted by a central semi-cylindrical alignment member. The shoulder has a width which preferably matches the thickness of the insert to be attached. The insert is formed of PDC and is a circular disk or segment of a disk which is hollow at the central portion. Moreover, it is faced with a thin layer of about 30 mils of PDC material. The blank is cut along two radii (or a diameter) to form two separate PDC inserts which are required for a single drill bit.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a side view showing the bifurcated cutter of the present disclosure which comprises an elongate shank, a cutter body and perpendicular faces permitting a PDC insert to be anchored thereon;

FIG. 2 is a view of the cutter shown in FIG. 1 which has been rotated to an orthogonal position;

FIG. 3 is a sectional view along line 3—3 of FIG. 1 which shows details of construction of the shank;

FIG. 4 is a sectional view along the line 4—4 of FIG. 2 showing the shape of the cutter head viewed from below; and FIG. 5 shows the cutter in an isometric view.

FIG. 6 shows the cutter insert formed of PDC which is a circular disk or segments which is axially hollow formed of PDC.

DETAILED DESCRIPTION OF THE PREFERRED EMBODIMENT

Attention is first directed to FIG. 1 of the drawings where the numeral 10 identifies the cutter of the present disclosure. It is formed on a shank or stem 12 which enables connection with a suitable chuck and drill motor. Momentarily diverting attention to FIG. 3 of the drawings, the stem is there shown in sectional view and comprises an elongate mating member which is drilled with a pair of mounting holes 14 for easy connection with the chuck. The cutter stem 12 extends to the cutter head 18 which is shown better in the sectional view of FIG. 4. There, it will be observed that the head 18 is circular in profile having two 100° notches. This leaves a head which has a maximum diameter of about 1 to 3 inches depending on the sized required. The diameter of the head as shown in FIG. 4 relates to the gauge of the hole to be drilled. The outer face 20 of the head 18 assures that the cutter makes contact with the hole to enable cutting to the required gauge diameter. More will be noted concerning this hereinafter. The cutter thus has some resemblance to a bow tie as illustrated in FIG. 4. Considering the notches of 100° which are on opposite sides, the head 18 supports left and right duplicate cutters which are at opposite parts of the head as shown in FIG. 4. In other words, the head requires substantial body to assure that it can handle the stresses occurring in operation. The cylindrical face 20 is also shown on the exterior of the head in FIGS. 1 and 2.

Viewing FIGS. 2 and 4 jointly, it will be observed that the respective views are aligned in accordance with drafting conventions to show the location of the cutter insert to be described. On the opposite side of the head as viewed in FIG. 4 of the drawings, the body portion 18 has been intercepted with an angular face 26. The face 26 extends from the face 28 shown in FIG. 4 of the drawings. In other words, that is one edge of the face 26. The face 26 slopes into the head 18 and present an alignment surface which is cylindrical in shape. This alignment surface 30 is semi-cylindrical and has a length which matches the length of the sloping face 26. The face 26 shown in FIG. 2 of the drawing) extends from the face 28 at the left hand end to the outer curving surface 20 of the head 18. The sloping face 32 best shown in FIG. 1 of the drawings in conjunction with the sloping face 26 defines a mounting area for an insert. The insert is a base semi-cylindrical member 44 having an end located PDC face 46. The insert member 44 is faced with PDC to bear the shock loading. This insert, faced of PDC material, is positioned when installed to accomplish all the aspects of cutting. Momentarily diverting attention to FIG. 6 of the drawings, a circular segment which is centrally hollow and which is defines along a diameter a PDC faced insert having a central, concentric opening 42 and also has a diameter 30 which matches the diameter of the semi-cylindrical alignment surface 30 on the face 26, The circular segment disk 44 is duplicated on two mounting surfaces of the drill bit 10. More specifically, this arrangement of the PDC faced inserts on the drill bit 10 enables the required life for the tool 10. Going back now to FIG. 1 of the drawings, an insert 46 is shown mounted on the head 18. It is joined by brazing to the faces 26 and 32. Further, the brazing material can be also placed on the semi-cylindrical alignment surface 30 to assure proper locking of the insert 44.

The PDC insert is constructed with a diamond layer 46 which is bonded to the semi-cylindrical insert 44. The PDC layer 46 has a thickness preferably in the range of 15 to about 40 mils. Probably, optimum proficiency without undue waste of the material is achieved by thickness in the range of about 20 to 30 mils. It is also acceptable to use a PDC insert thickness of about 7 to 10 mils. If thinner, it may tend to shatter with impact. It is bonded by brazing on the insert 44. Furthermore, the insert 44 is mounted as shown in FIGS. 1 and 2 of the drawings, and it may be necessary to remove a portion of the insert 44 to conform to the diameter of the outer face 20. Going now to FIG. 2 of the drawings, the region 48 which comprises an exposed outer surface portion of the insert 44 can be machined to remove a very thin part of it. If this is done, this enables the insert 44 to cut to the hole gauge diameter from the beginning. Otherwise, it might be slightly oversized and require slight machining to reduce thickness in this area. This depends on the relative position on the face 26 of the insert 44 and, if desirable, the insert 44 can be positioned so that the amount of finish machining is reduced during the step of attaching the insert 44.

It goes without saying that the two inserts 44 are attached in the same fashion. While the drawings only illustrate one of the two inserts mounted, the second insert is also mounted in the same fashion but that is obscured. Dotted line representation of that other face would make the drawings exceedingly confusing. It is better to illustrate only one and to note specifically for the record that the second insert is mounted in the same fashion. Emphasizing the use of two inserts, it is again noted that FIG. 4 shows the head formed into a bow tie construction because of the facing 100° notches which narrow the head at one dimension while it remains full gauge in the illustrated fashion. This provides substantial body to support the two inserts and enable the two inserts to rotate, thereby confronting the drill hole with two cutters which are rotated against the working face during drilling.

Use of this device involves mounting the stem 12 in a chuck and drilling a hole. During operation, the PDC face 46 withstands the brunt of shock from drilling. That face is the portion of the tool which breaks the rock during operation. As the drill bit is advanced, it will be observed that the face 46 is presented against the hole so that cutting is done during rotation. As the drilling process continues, the heft of the insert 44 which is jammed up against the supporting surfaces 26 and 32 transfers the shock and impact into the body 18 so that stresses are appropriately distributed to the bulk of the body. In other words, it is possible to drill with substantial chatter and shock loading which transfers stress into the body 18 which has sufficient structural size and strength to resist the shock and impact. This assures that long life is obtained during use of the device. In one particular embodiment, the head 18 diameter is 1.312 inches while the face 26 supports the semi-cylindrical alignment curvature which has a diameter of 0.354 inches. The face 32 is set back by a distance of 0.315 inches so that the insert 44 preferably measures 0.315 inches in height taking into account the PDC layer 46 which is approximately 20 to 30 mils in thickness as previously mentioned.

The PDC face 46 is positioned at an angle of about 20° with respect to the centerline axis of the drill bit 10. The face 26 is positioned at an angle of about 20° also. The side rake angle is typically in the range of 0° to about 5°. For the dimensions just mentioned, insert 44 is constructed with a diameter of approximately 0.618 inches. This enables the drill bit 10 of the present disclosure to drill a hole having a nominal diameter of 1.375 inches. The stem 12 is about 0.5 inches in both dimensions. Conformance with an industry standard chuck mounting mechanism is obtained through the use of the drill hole which measures about 0.22 inches in diameter. The two holes are preferably spaced approximately 0.825 inches apart. While the foregoing is directed to the preferred embodiment, the scope is determined by the claims which follow.

We claim:

1. An improved bifurcated drill bit for drilling a hole to a selected diameter, comprising:

(a) a mounting stem;

(b) a head connected to said stem and having a centerline axis of rotation wherein said head has a pair of spaced cutting faces and said head positions said faces for cutting the hole and wherein each of said cutting faces includes:

(1) an insert having a face of diamond material;

(2) intersecting and sloping shoulders supporting said insert to enable said insert to cut the hole during drilling; and (3) wherein said face of diamond material comprises an exposed face rotated on said head into cutting contact while drilling;

(c) wherein said insert comprises a segment of cylindrical member of right cylindrical geometry having:

(1) a planar back face;

(2) a second face perpendicular to said back face;

(3) an insert locking surface; and (d) wherein said locking surface is a cylindrical surface portion and fits against said insert, and said insert is a segment of a circular disk having a central hole, and said central hole diameter is equal to the diameter of said locking surface cylindrical surface portion.

2. The drill bit of claim 1 wherein said insert comprises a segment of a cylinder inscribing an arc of at least about 30°.

3. The drill bit of claim 2 wherein said insert includes a layer of diamond material of at least about 7 mm thickness.

4. The drill bit of claim 1 wherein said diamond material inserts are brazed to said rotatable head at said spaced cutting faces.

5. The apparatus of claim 1 wherein said diamond material inserts have an outer periphery which is a segment of a circle, and said circle segment is positioned on said cutting faces so that said circular segment is brought toward the hole during drilling and contact anywhere on said diamond material inserts is initiated at said circular segment.

6. The apparatus of claim 1 wherein said diamond material inserts are formed of diamond material in sheet form defined by upper and lower parallel faces having a finite spacing.

7. The drill bit of claim 1 wherein said drill bit insert has an outer edge portion sized and shaped to conform to said circular head to enable cutting a hole to gauge.

8. The drill bit of claim 1 wherein said head has a cylindrical outer face with two omitted portions defining angular interruptions, and said cutting faces are adjacent said interruptions so that said inserts are positioned to contact the hole during drilling.

9. The drill bit of claim 8 wherein said head includes first and second cutting faces located at 180° angular spacing around said head.

10. The drill bit of claim 1 wherein said diamond clad inserts comprise a segment of a cylinder having a cylindrical outer face and said segment inscribes an arc of up to about 180° and said insert is defined by a bottom most edge wherein the bottom most edge is abutted against two faces on said head for registration thereon.

11. A drill bit comprising a mounting stem attached to a rotatable cylindrical head having two opposing notched sections wherein said head comprises:

(a) each of said notched sections is parallel with the longitudinal axis of said rotatable cylindrical head;

(b) said notches are sized to leave two opposing segments of said rotatable cylindrical head wherein each said segment is greater than 40 degrees and less than 150 degrees;

(c) each of said segments has a leading face in the direction of rotation; and (d) wherein each said leading face is notched at an angle to the longitudinal axis of said rotatable cylindrical head, and wherein an insert is mounted on each said angled leading face said insert having a cutting surface to engage said drill bit in a drilling operation.

12. The drill bit of claim 11 wherein said cutting surface is diamond.

13. The drill bit of claim 11 wherein said insert is brazed to said angled leading face.

14. The drill bit of claim 11 wherein said insert is an annular segment and is engaged concentrically to an inner cylindrical segment on said angled leading face.

* * * * *